US006171443B1

(12) United States Patent
Goettmann et al.

(10) Patent No.: US 6,171,443 B1
(45) Date of Patent: Jan. 9, 2001

(54) RECYCLABLE POLYMERIC SYNTHETIC PAPER AND METHOD FOR ITS MANUFACTURE

(75) Inventors: James A. Goettmann, North East, PA (US); Peter J. Angelini, Central Valley, NY (US); Stephen H. Monroe, Germantown, TN (US); John R. Boylan, Newtown, PA (US)

(73) Assignee: Polyweave International, LLC, Memphis, TN (US)

( * ) Notice: Under 35 U.S.C. 154(b), the term of this patent shall be extended for 0 days.

(21) Appl. No.: 08/470,861

(22) Filed: Jun. 6, 1995

Related U.S. Application Data

(63) Continuation of application No. 08/004,881, filed on Jan. 19, 1993, now abandoned, which is a continuation-in-part of application No. 07/823,525, filed on Jan. 21, 1992, now abandoned, and a continuation-in-part of application No. 07/916,819, filed on Jul. 20, 1992, now Pat. No. 5,403,444, which is a continuation-in-part of application No. 07/489,427, filed on Mar. 5, 1990, now Pat. No. 5,133,835.

(51) Int. Cl.[7] ..... D21H 13/14; D21H 19/72
(52) U.S. Cl. ..... 162/135; 162/146; 162/157.5
(58) Field of Search ..... 162/146, 157.2, 162/157.3, 157.5, 135

(56) References Cited

U.S. PATENT DOCUMENTS

| | | | | |
|---|---|---|---|---|
| 2,684,775 | | 7/1954 | Von Hofe | 216/21 |
| 2,999,788 | | 9/1961 | Morgan | 162/146 |
| 3,097,127 | | 7/1963 | Ostmann | 162/146 |
| 3,097,991 | | 7/1963 | Miller et al. | 162/157 |
| 3,101,294 | | 8/1963 | Fridrichsen | 162/146 |
| 3,114,670 | * | 12/1963 | Iwasaki | 162/146 |
| 3,158,532 | | 11/1964 | Pall et al. | 162/103 |
| 3,489,643 | | 1/1970 | Hoffman | 162/146 |
| 3,515,634 | | 6/1970 | Sommer et al. | 162/146 |
| 3,674,621 | | 7/1972 | Miyamoto et al. | 162/146 |
| 3,743,570 | | 7/1973 | Yang et al. | 162/157.5 |
| 3,891,499 | | 6/1975 | Kato et al. | 162/157.5 |
| 3,902,957 | * | 9/1975 | Kozlowski | 162/157.5 |
| 3,928,496 | * | 12/1975 | Takeda et al. | 162/146 |
| 4,013,751 | * | 3/1977 | Davis et al. | 162/157.5 |
| 4,049,492 | * | 9/1977 | Lare | 162/157.5 |
| 4,084,035 | | 4/1978 | Arpin et al. | 428/352 |
| 4,162,180 | | 7/1979 | Burton et al. | 156/220 |
| 4,210,487 | | 7/1980 | Driscoll | 162/146 |
| 4,333,968 | | 6/1982 | Nahmias | 427/173 |
| 4,365,002 | | 12/1982 | Takahashi et al. | 428/483 |
| 4,460,647 | | 7/1984 | Keith | 428/369 |
| 4,496,583 | | 1/1985 | Yamamoto et al. | 428/288 |
| 4,501,641 | | 2/1985 | Hirakawa et al. | 162/164.3 |
| 4,615,689 | | 10/1986 | Murray et al. | 493/51 |
| 4,626,456 | | 12/1986 | Farrell et al. | 428/35 |
| 4,656,094 | | 4/1987 | Kojima et al. | 428/412 |
| 4,657,804 | | 4/1987 | Mays et al. | 428/212 |
| 4,668,566 | | 5/1987 | Braun | 428/286 |
| 4,678,823 | | 7/1987 | Jabloner | 524/62 |
| 4,713,289 | | 12/1987 | Shiffler | 428/361 |
| 4,728,394 | | 3/1988 | Shinjou et al. | 162/146 |
| 4,837,075 | | 6/1989 | Dudley | 428/220 |
| 4,894,280 | | 1/1990 | Guthrie et al. | 428/224 |
| 4,904,324 | | 2/1990 | Heider | 156/214 |
| 4,941,947 | | 7/1990 | Guckert et al. | 162/103 |
| 4,973,382 | | 11/1990 | Kinn et al. | 162/146 |
| 4,986,866 | | 1/1991 | Ohba et al. | 156/220 |
| 5,000,824 | | 3/1991 | Gale et al. | 162/157.5 |
| 5,006,394 | | 4/1991 | Baird | 428/138 |
| 5,009,747 | | 4/1991 | Viazmensky et al. | 162/115 |
| 5,047,121 | | 9/1991 | Kochar | 162/146 |
| 5,061,538 | | 10/1991 | Hendrix et al. | 428/74 |
| 5,133,835 | | 7/1992 | Goettmann et al. | 162/146 |

FOREIGN PATENT DOCUMENTS

| | | | |
|---|---|---|---|
| 787649 | 6/1968 | (CA) | 92/62 |
| 0 193 798 | 9/1986 | (EP) . | |
| 708622 | 7/1951 | (GB) . | |
| 58-17482 | 5/1973 | (JP) . | |
| 53-78304 | 7/1978 | (JP) . | |
| 54-2284 | 2/1979 | (JP) . | |
| 54-101919 | 8/1979 | (JP) . | |
| 58-76598 | 5/1983 | (JP) . | |
| 63159599 | 12/1986 | (JP) | D21H/5/20 |
| 1-266300 | 10/1989 | (JP) . | |
| 2-216295 | 8/1990 | (JP) . | |
| 2-300398 | 12/1990 | (JP) . | |
| 61-225316 | 10/1996 | (JP) . | |

OTHER PUBLICATIONS

Casey, *Pulp and Paper*, 3rd Ed., vol. II (1980) Wiley—Interscience, p. 1132, 1173–1176.*

Casey, *Pulp and Paper*, 3rd Ed (1980), vol. II, p. 1151.*

"Synthetic Fiber Papers proved in Pilot Mill Runs", Paper Trade Journal, Mar. 5, 1966, pp. 38,40.

Publication "Research Disclosure 102", Oct. 1972, pp. 24–25.

* cited by examiner

*Primary Examiner*—Peter Chin
(74) *Attorney, Agent, or Firm*—Dara L. Onofrio, Esq.

(57) ABSTRACT

A high-opacity cellulose-free synthetic paper is formed from a wet-laid nonwoven web of thermoplastic fibers, all or most of which fibers are made of a predetermined polymeric material. The wet-laid web is dried to remove excess water, drying being carried cut at temperatures below the melting temperature of the predetermined polymeric material. The dried nonwoven web is saturated on at least one side with a pigmented binder forming a continuous coating thereon. The binder is cured at temperatures below the melting temperature of the predetermined polymeric material.

18 Claims, 2 Drawing Sheets

RECYCLABLE POLYMERIC SYNTHETIC PAPER AND METHOD FOR ITS MANUFACTURE

This is a continuation of application Ser. No. 08/004,881 filed on Jan. 19, 1993 abandoned which is a C-I-P of Ser. No. 07/823,525 filed Jan. 21, 1992 abandoned and a C-I-P of Ser. No. 07/916,819 filed Jul. 20, 1992 now U.S. Pat. No. 5,403,444 which is a C-I-P of Ser. No. 07/489,427 filed Mar. 5, 1990 now U.S. Pat. No. 5,133,835.

FIELD OF THE INVENTION

This invention generally relates to synthetic paper made on conventional continuous wet-lay papermaking equipment. In particular, the invention relates to recyclable polymeric synthetic paper made of 100% polymeric material.

The invention also relates to labels, especially to labels adapted for use in labeling of blow-molded plastic containers. In particular, the label comprises a coated 100% synthetic web prepared by a wet-lay process. The label may be applied either in-mold or post-mold to a blow-molded container made of the same synthetic material as the main synthetic fiber component (for example, polyethylene, polyester or polypropylene) of the label with or without the use of an adhesive material and may be recycled along with the container.

BACKGROUND OF THE INVENTION

It is conventional practice to make synthetic paper using synthetic pulp comprising short fibers of polyethylene. Such synthetic paper is made using polyethylene pulp with or without cellulose fibers. Such flexible polymeric synthetic substrates are used to make water-resistant cardboard, embossed paper, heat-sealing paper, battery separators, felt mats, hygienic absorbents and building materials. To meet the demands of various applications, many grades of polyethylene have become commercially available. These synthetic pulp products use polyethylenes of different physical properties. Polypropylene and polypropylene/polyethylene products are also known.

U.S. Pat. No. 5,047,121 to Kochar discloses a process for making synthetic paper containing at least 97 wt. % polyethylene on conventional continuous wet-lay papermaking equipment. The process includes the steps of: (1) preparing a pulp furnish comprising 97–99.5 wt. % polyethylene fibers and 0.5–3.0 wt. % polyvinyl alcohol binder fibers; (2) depositing the pulp furnish on the screen of a wet-lay papermaking machine to form a waterleaf sheet; (3) drying the resulting waterleaf sheet on heated drying cans having a drying profile wherein an initial drying phase is provided at a temperature between 200° F. and 270° F. to melt the polyvinyl alcohol fibers and a second drying phase is provided at a temperature between 190° F. and 240° F. to control stretch and elongation of the sheets; and (4) thermally bonding the dried sheet at a temperature between 250° F. and 315° F. to provide polyethylene paper. The thermal bonding can be accomplished with a calendar roll. The Kochar patent teaches that: (1) the strength of the synthetic paper can be tailored by varying the amount of polyvinyl alcohol fibers mixed into the polyethylene pulp; and (2) the porosity of the synthetic paper can be tailored by varying the bonding temperature.

In accordance with the teaching of the Kochar patent, the polyethylene pulp is fused to a degree dependent on the thermal bonding temperature. This results in a polyethylene paper which is suitable for the specific applications identified in that patent, i.e., filtration applications (e.g., vacuum cleaner bags) and battery separators. However, the low opacity of the resulting paper makes it unsuitable for use in high-quality printing. This is because the application of too much heat for a long duration causes the polyethylene pulp to flow to such a degree that it becomes increasingly translucent as it approaches a polyethylene film in structure.

Paper made of 100% synthetic fibers is useful as label paper. For example, the in-mold labeling of blow-molded plastic containers is less costly than conventional labeling methods in which labels with adhesive backing are adhered to the container in a separate step subsequent to blow molding. In-mold labeling eliminates this separate step, thereby reducing labor costs associated with handling of the adhesive-backed labels and capital costs associated with the equipment used to handle and apply adhesive-backed labels.

In accordance with conventional in-mold labeling of blow-molded plastic containers, labels are sequentially supplied from a magazine and positioned inside the mold by, for example, a vacuum-operated device. Plastic material is then extruded from a die to form a parison as depicted in FIG. 6 of U.S. Pat. No. 4,986,866 to Ohba et al., the description of which is specifically incorporated by reference herein. The mold is locked to seal the parison and then compressed air is fed from a nozzle to the inside of the parison to perform blow molding wherein the parison is expanded to conform to the inner surface of the mold. Simultaneously with the blow molding, the heat-sealable layer of the label of Ohba et al. is pressed by the outer side of the parison and fused thereto. Finally, the mold is cooled to solidify the molded container and opened to obtain a labeled hollow container.

For the sake of efficiency, it is desirable that the labeling of blow-molded containers be conducted continuously and rapidly. Also the labels to be applied during in-mold labeling should be sufficiently stiff that the automatic equipment used to handle the labels does not cause wrinkling or folding thereof. Conversely, the labels must be sufficiently elastic that they neither tear nor separate from the plastic container during flexing or squeezing of the latter.

A further disadvantage of conventional in-mold labels prepared from paper is that prior to recycling of the plastic container, the paper label must be removed using either solvent or mechanical means to avoid contamination of the recycled plastic material by small pieces of paper.

One prior art attempt to grapple with this recycling problem is disclosed in U.S. Pat. No. 4,837,075 to Dudley, which teaches a coextruded plastic film label for in-mold labeling of blow-molded polyethylene containers. The label comprises a heat-activatable ethylene polymer adhesive layer and a surface printable layer comprising polystyrene. The heat activatable adhesive substrate layer comprises a polyethylene polymer. Pigment or fillers are incorporated in the polystyrene layer to provide a suitable background for printing. An example of a suitable pigment is titanium dioxide and an example of a suitable filler is calcium carbonate. Preferably a layer is interposed between the adhesive substrate and the surface printable layer that comprises reground and recycled thermoplastic material used to prepare such labels. The label stock is prepared by coextrusion of the various label layers utilizing conventional coextrusion techniques. Separately applied adhesive is not employed.

The aforementioned patent to Ohba et al. teaches a synthetic label for in-mold labeling of blow-molded resin containers comprising a thermoplastic resin film base layer and a heat-sealable resin layer having a melting point lower than that of the thermoplastic resin base layer. The base layer has an inorganic filler, such as titanium dioxide or calcium carbonate, incorporated therein or incorporated in a latex coating thereon. The base layer may, for example, be high-density polyethylene or polyethylene terephthalate. The heat-sealable resin layer may, for example, be low-density polyethylene. The heat-sealable resin layer serves to firmly adhere the label to a resin container. In accordance with the preferred embodiment of the Ohba et al. label material for use on a blow-molded container made of polyethylene, four separate layers are joined together by coextrusion.

U.S. Pat. No. 5,006,394 to Baird teaches a polymeric film structure having a high percentage of fillers, for example, opacifying or whitening agents such as titanium dioxide and calcium carbonate. The fillers are concentrated in a separate filler containing layer coextruded with a base layer. The base layer may comprise polyolefins (for example, polyethylenes), polyesters or nylons. The filler-containing layer may comprise any of the same polymeric materials, but preferably comprises ethylene vinyl acetate coploymer. However, this film material is intended for use in disposable consumer products such as diapers.

In addition, U.S. Pat. No. 4,941,947 to Guckert et al. discloses a thermally bonded composite sheet comprising a layer of flash-spun polyethylene plexifilamentary film-fibril strand sheet in face-to-face contact with a layer of polyethylene synthetic pulp suitable for use in bar code printing. The layer of polyethylene synthetic pulp is formed by conventional wet-lay papermaking techniques.

The Dudley and Ohba et al. patents both disclose an in-mold label having a multiplicity of layers coextruded together. This complexity of structure raises the costs of manufacturing the respective in-mold label materials. Although there is no suggestion in the Baird patent that the film material disclosed therein would be suitable for use as in-mold label paper, if it were usable for that purpose it would suffer from the same disadvantage of being a relatively complex laminated structure and therefore relatively costly to manufacture. Likewise the patent to Guckert et al. discloses a laminated structure.

SUMMARY OF THE INVENTION

The present invention improves upon the prior art by providing a flexible polymeric synthetic nonwoven substrate which is suitable for use as lint-free writing paper, labels on plastic bottles, release liner, specialty packaging paper or filter paper. In particular, one preferred embodiment of the invention is a high-opacity polymeric synthetic nonwoven substrate suitable for use in high-quality printing applications.

In addition, the polymeric synthetic paper of the invention contains no cellulosic fibers and therefore can be easily recycled without costly procedures for separating polymeric and cellulosic materials. In particular, it is an object of the invention to provide a synthetic paper which does not leave behind any foreign material to be screened out when the paper is melted.

The synthetic paper in accordance with the invention can be used as labels on polymeric containers, for example, labels for blow-molded polymeric containers, which need not be removed prior to recycling of the polymeric containers. Such labels sufficiently elastic to withstand flexing and squeezing of the plastic container without tearing or separating therefrom. Also the nonwoven label of the invention is more porous than film labels, which enhances the printability of the label, and is cheaper to manufacture.

In accordance with the invention, the synthetic paper comprises a nonwoven web of fibers, at least one side of which has a pigmented coating, e.g., a pigment-containing latex. The paper is manufactured from commercially available fibers. The components may be combined in water into a homogeneous mixture and then formed into a web employing a wet-lay process.

In accordance with a first preferred embodiment, the fiber composition of the web is 88–100% polyethylene pulp and 0–12% polyvinyl alcohol binder fibers. In a variation of this embodiment, the web comprises 70–100% polyethylene pulp, 0–12% polyvinyl alcohol binder fibers and 0–30% polypropylene fibers. Polypropylene pulp can be substituted for all or any portion of the polyethylene pulp.

In accordance with another preferred embodiment, the fiber composition of the web is 50–90% chopped polyester staple fibers, 10–40% bicomponent polyester/co-polyester core/sheath binder fibers and 0–10% polyvinyl alcohol binder fibers bonded together. Each bicomponent binder fiber comprises a core of polyester surrounded by a co-polyester sheath.

In both preferred embodiments, the nonwoven web of fibers is made more printable by saturation with a binder material, for example, with an ethylene vinyl acetate latex or other suitable latex having a glass transition temperature ($T_g$) of 0–30° C. The latex is preferably compounded to contain pigment such as calcium carbonate, titanium dioxide or both at pigment/binder ratios of 0.5/1 to 8/1, resulting in a synthetic paper having a surface suitable for high-quality printing thereon. However, the use of a latex binder, as opposed to other conventional binders, is not required to practice the invention.

DETAILED DESCRIPTION OF THE PREFERRED EMBODIMENTS

Figure 1:
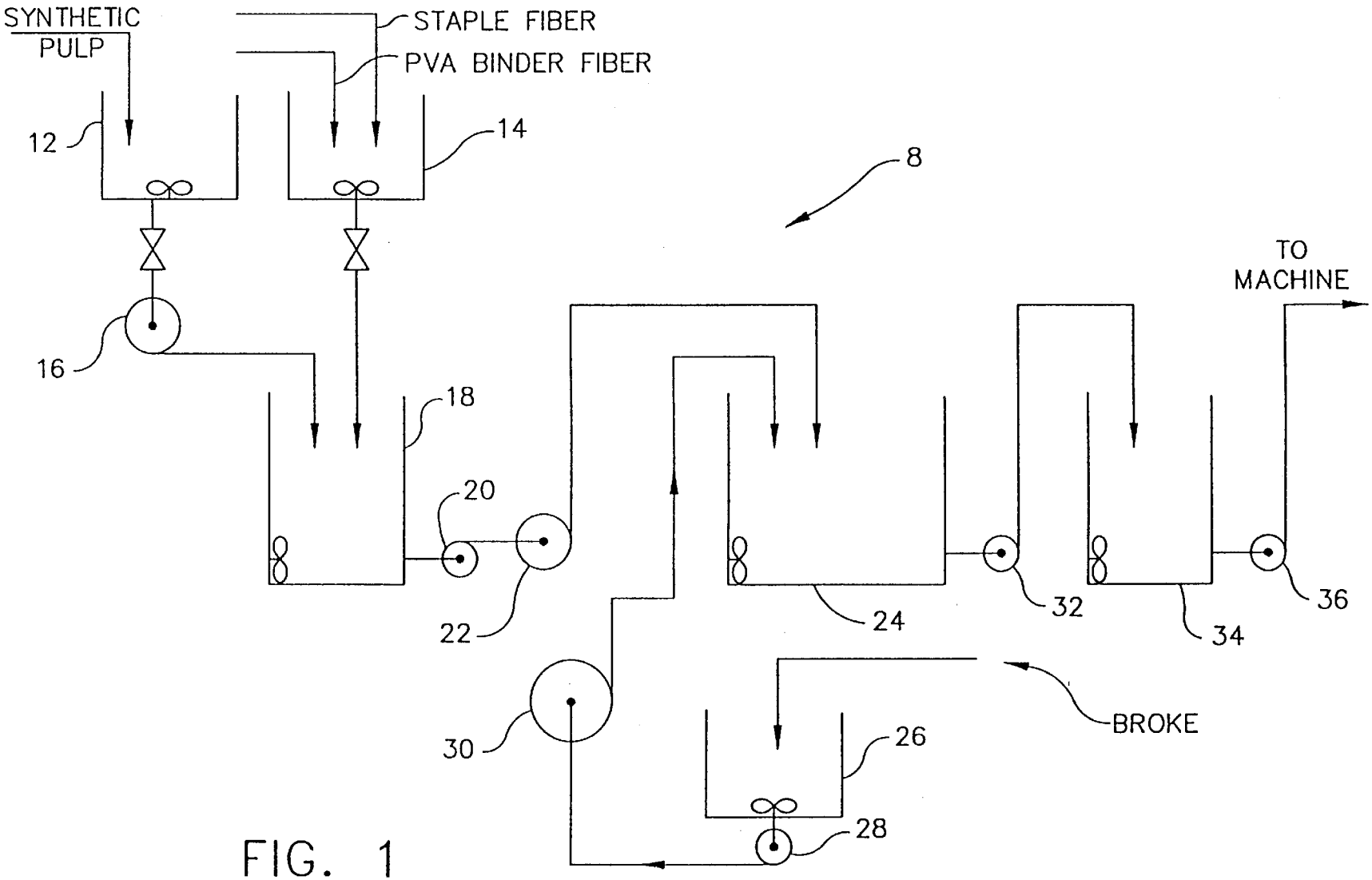
FIG. 1 is a diagram showing the production line for making up the stock for use in manufacturing the synthetic paper in accordance with the invention.

In accordance with the invention, synthetic paper is formed from a web of synthetic fibers with no cellulosic fibers. The synthetic fibers may be made of polyethylene, polyester, polypropylene or any other polymeric material suitable for use in high-opacity paper.

In accordance with a first preferred embodiment, the web comprises 88–100% polyethylene fibers and 0–12% polyvinyl alcohol fibers and is coated with an ethylene vinyl acetate latex or other suitable latex having a glass transition temperature ($T_g$) of 0–30° C. and compounded to contain pigment such as calcium carbonate, titanium dioxide, clay, talc or other inorganic pigments as known to those skilled in the art. The coating may contain any conventional binder other than latex.

The synthetic paper in accordance with the invention is manufactured from commercially available fibers such as polyethylene pulp, polypropylene pulp, chopped polyester staple fibers and polyvinyl alcohol binder fibers. The components may be combined in water into a homogeneous mixture and then formed into a mat employing a wet-lay process.

In accordance with a first example of a polyethylene-based synthetic paper, the starting fiber materials consist of 90 wt. % Mitsui 9400 Fybrel™ polyethylene pulp commercially available in the United States from Minifibers, Route 14, Box 11, Johnson City, Tenn. 37615 and 10 wt. % Kuraray 105-2 polyvinyl alcohol (PVA) binder fibers commercially available in the United States from Itochu Corp., 335 Madison Avenue, New York, N.Y. 10017. In Mitsui 9400 Fybrel™ polyethylene pulp the polyethylene fibers have an average length of 0.90 mm and a diameter of 15 microns. Kuraray 105-2 PVA binder fibers have an average length of 5 mm and a denier of 2.0.

In accordance with a second example of a polyethylene-based synthetic paper, the starting fiber material may be 100 wt. % Mitsui 9400 Fybrel™ polyethylene pulp, that is, PVA binder fibers are not essential to practice of the invention. In this embodiment, the polyethylene pulp is entangled during the wet lay process to form the base sheet. Optionally, the base sheet may thereafter be coated with the pigmented binder—avoiding thermal fusion of the polyethylene pulp—to produce a high-opacity synthetic paper having excellent printability.

Alternatively, in accordance with a variation of the polyethylene-based synthetic paper, some of the Kuraray 105-2 PVA binder fibers are replaced by 10 mm×2.2 denier Hercules Herculon™ polypropylene staple fibers. These polypropylene staple fibers are commercially available in the United States from Hercules, Inc., 3169 Holcomb Bridge Road, Suite 301, Norcross, Ga. 30071. In accordance with this variation the web is comprised of 70–100% polyethylene fibers, 0–12% PVA fibers and 0–30% polypropylene fibers. One example of this variation successfully made by the inventors had 85% polyethylene fibers, 7.5% PVA fibers and 7.5% polypropylene fibers.

In all of the foregoing variations, polypropylene pulp can be substituted for the polyethylene pulp.

After the base mat has been dried, it is preferably treated with a coating comprised of a binder, e.g., latex, pigmented with calcium carbonate, titanium dioxide, clay, talc or other inorganic pigment to enhance the printability of the paper. The surface treatment may be applied with any commercially available coater, treater or size press. Thereafter the web can be machine calendared to give the coating a predetermined surface smoothness.

In accordance with the preferred embodiment of the coating applied to the above-described webs, the starting coating materials are 50 wt. % Vinac 884 ethylene vinyl acetate latex and 50 wt. % Albagloss calcium carbonate. Alternatively, Airflex 4514 ethylene vinyl acetate/ethylene vinyl chloride copolymer latex can be used in place of the Vinac 884 ethylene vinyl acetate latex, although the latter is preferred. The Vinac 884 and Airflex 4514 latexes are commercially available in the United States from Air Products and Chemicals, Polymers and Chemicals Division, 5100 Tilghman Street, Allentown, Pa. 18104. The Albagloss calcium carbonate is commercially available in the United States from Pfizer, Inc., Minerals, Pigments and Metals Division, 640 North 13th Street, Easton, Pa. 18042-1497.The range of calcium carbonate incorporated in the coating can be varied from a pigment/binder ratio of 0.5/1 to 8/1, although the preferred ratio is 1/1.

Figure 2:
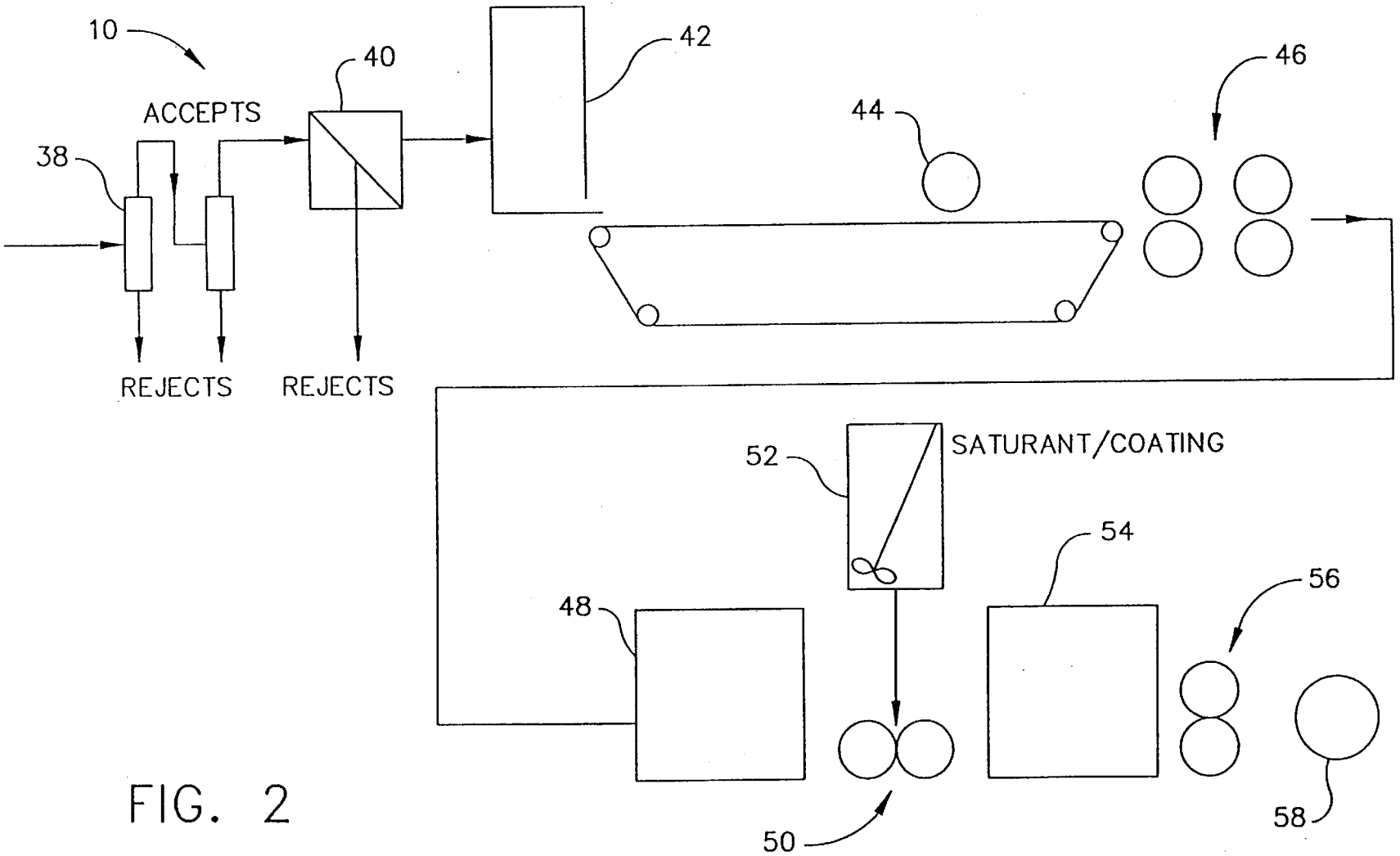
FIG. 2 is a diagram showing the production line for making synthetic paper in accordance with the invention from the stock make-up output by the apparatus of FIG. 1.

The synthetic paper in accordance with the invention can be made on standard papermaking equipment. The process for making label paper prepared from a web of polyethylene pulp, PVA binder fibers and polypropylene staple fibers is described hereinafter with reference to FIGS. 1 and 2, which show the stock make-up equipment 8 and the papermaking equipment 10, respectively.

The Fybrel™ 9400 polyethylene pulp is loaded in a fiber opening chest 12 at consistencies between 2% and 5% solids. The pulp is agitated until it is completely dispersed in water and no fiber bundles are apparent. This mixture is then pumped to a blend chest 18 via a deflaker 16. In the deflaker the fibers are subjected to fiber-to-fiber agitation which removes any fiber bundles or unopened clumps. The def laker is preferable to a disk refiner in that no cutting or shortening of the fibers occurs.

At the same time a predetermined amount of Kuraray 105-2 PVA binder fibers and, optionally, a predetermined amount of polypropylene staple fibers are loaded in a fiber opening chest 14 at consistencies between 0.5% and 5% solids in hot water. The PVA binder fibers become gelatinous in hot water. The dispersion is agitated until the staple fibers are completely dispersed in water and no fiber bundles are apparent. This mixture is then pumped into blend chest 18. Alternatively, no pump is needed if the mixture is dropped by gravity into blend chest 18. The binder and staple fiber dispersion is added to the furnish so that the PVA binder fibers and the staple fibers make up 0–12 wt. % and 0–30 wt. % of the furnish solids, respectively. The mixture is agitated to achieve a uniform dispersion of the polyethylene pulp, staple fibers and gelatinous PVA having a consistency between 1% and 5% solids.

The furnish is then pumped by pump 20 to the refiner 22, which beats the fibers as needed to reduce their average length. The refined furnish then enters a surge chest 24, where it is mixed with the broke furnish from broke pulper 26.

Broke is synthetic paper that has been rejected during the process of manufacture. Broke may take the form of either "wet" broke or "dry" broke. Wet broke is synthetic paper taken off the wet press of the paper machine. Dry broke is paper spoiled when passing through the dryers or the calendar, trimmed off in the rewinding of rolls, trimmed from sheet being prepared for shipping or rejected for manufacturing defects.

In accordance with the process of the invention, the broke is loaded in the broke pulper 26 at consistencies between 1% and 5% solids. The broke furnish is agitated by high-shear agitator 28 until the broke fibers are completely dispersed in water and no fiber bundles are apparent. The broke furnish is then pumped to surge chest 24 via a deflaker 30 in a controlled manner to maintain consistency and limit the percent of broke addition to not exceed 20% of the total volume. The refined furnish and the broke furnish are mixed in surge chest 24 until a uniform dispersion is achieved.

The furnish in surge chest 24 is then pumped via pump 32 into machine chest 34, which feeds its contents into the forming section while maintaining a constant level in the chest to reduce variation in product weight. The final stock is pumped to the papermaking machine (see FIG. 2) by pump 36.

Before the stock is made into synthetic paper, large contaminants (such as dirt, gravel, pieces of kraft bags, sand and grit) and fiber bundles are removed from the stock by screening in primary and secondary cleaners 38 and 40. Material containing rejected debris is fed to the secondary cleaners from the primary stage. Rejects from the secondary stage are sewered while accepts are sent back to the main feed stream. This is a way to concentrate the rejects and save fiber.

The furnish is supplied to the headbox 42 at consistencies between 0.1% and 1% solids. A web of synthetic fibers is then formed on standard wet-lay papermaking equipment by forming wire 44. Excess water is removed by gravity and vacuum devices. The formed web is wet-pressed in press section 46 and then dried in the first dryer section 48 at a temperature in the range of 140° F. to 260° F. to remove more water.

During drying, the polymeric fibers are not fused, but rather the gelatinous PVA becomes a glue which pre-bonds the polyethylene pulp and staple fibers into a web. (For applications where high strength is not a requirement, PVA is unnecessary. For example, 100% polyethylene pulp entangled by the wet-lay process has adequate strength to be fed to the saturator/coater.) When drying the web, care must be taken to ensure that the web and dryer can temperatures remain below the melting point of the polyethylene fibers, that is, below 269° F. (132° C.). Otherwise the opacity of the synthetic paper will be degraded. The use of release coating on the dryer cans was found to be beneficial in preventing buildup or sticking that will eventually cause web defects and/or breaks.

Thereafter the dried web is saturated with ethylene vinyl acetate latex solution containing calcium carbonate pigment. This treatment may be performed on a paper machine size press or any type of off-line coater or treater 50 which is supplied with saturant from mixing chest 52. The coating is applied to the web in an amount that achieves a 10 wt. % add-on of dried coating solids, that is, 200 lbs/ton, although it will be recognized by the person skilled in the art that the weight percentage of dried coating solids can be varied over a wide range. The coating is then dried in the second dryer section 54, again at a temperature in the range of 140° F. to 260° F., whereby the ethylene vinyl acetate bonds the fibers to each other and bonds the pigment to the fibers. Excessive heat is to be avoided during saturation because the latex coagulates when exposed to excessive heat, leading to latex build-up on the rolls. After the coating is dried, the coated web is machine calendared in calendar 56 to attain a surface smoothness (Sheffield) of 125–250 units and is then wound on winding reel 58.

The physical properties of synthetic paper made from 90% polyethylene pulp and 10% PVA binder fibers in accordance with the invention are listed in Table I.

TABLE I

Physical Property Test Data

| TAPPI No. | Physical Property | Uncoated Base Sheet | Finished Coated Sheet |
|---|---|---|---|
| 410 | Basis Weight (3300 $ft^2$) | 45.0 | 50.0 |
| | ($oz./yd^2$) | 2.2 | 2.4 |
| 411 | Caliper (mils) | 8.8 | 8.0 |
| 251 | Porosity-Permeability Frazier Air (cfm) | <0 | <0 |
| 460 | Gurley Porosity (sec/100 cc) | 10 | 22 |
| 538 | Sheffield Smoothness (T/W) | — | 200/260 |
| 403 | Mullen Burst (psi) | — | 5 |
| 414 | Elmendorf Tear (g) (MD/CD) | — | 25/31 |
| 511 | MIT Fold (MD/CD) | — | 2/0 |
| 494 | Tensile (lbs/in.) (MD/CD) | 4.1/2.4 | 5.6/2.8 |
| 494 | Elongation (%) (MD/CD) | — | 4.3/6.5 |
| 494 | TEA (ft-lb/$ft^2$) (MD/CD) | — | 2.1/1.6 |
| 452 | GE Brightness (%) | 93.3 | 93.9 |
| 425 | Opacity (%) | 97.1 | 96.6 |
| 413 | Ash (%) (500° C.) | 0.0 | 3.0 |

In accordance with another preferred embodiment of the invention, the web comprises chopped polyester staple fibers, bicomponent polyester/co-polyester core/sheath binder fibers and PVA binder fibers. Each bicomponent binder fiber comprises a core of polyester surrounded by a co-polyester sheath. After the wet-laid sheet has been dried, the dried base sheet is thermal-bonded at a predetermined temperature and a predetermined pressure to bond the fibers on both surfaces of the sheet and impart strength. The sheet is then coated with an ethylene vinyl acetate latex having a glass transition temperature ($T_g$) of 0–30° C. Again the latex may be compounded to contain pigment such as calcium carbonate, titanium dioxide, clay, talc or other inoraganic pigments at pigment/binder ratios of 0.5/1 to 8/1. Because synthetic paper in accordance with these embodiments has no cellulosic fibers, the synthetic paper may be recycled without going through a separation process.

In accordance with a first example of the polyester-based synthetic paper of the invention, the starting fiber materials are 77 wt. % Kuraray polyester chopped strand, 19 wt. % Kuraray N-720 polyester/co-polyester core/sheath binder fibers and 4 wt. % Kuraray 105-2 PVA binder fibers. All of these fibers are commercially available in the United States from Itochu Corp., 335 Madison Avenue, New York, N.Y. 10017. The Kuraray chopped polyester staple fibers have an average length of 10 mm and a denier of 0.4. Kuraray N-720 polyester/co-polyester core/sheath binder fibers have an average length of 10 mm and a denier of 2.0. Kuraray 105-2 PVA binder fibers have an average length of 5 mm and a denier of 2.0.

In accordance with a second example of the polyester-based synthetic paper of the invention, the starting fiber materials are 80 wt. % Kuraray polyester chopped strand and 20 wt. % Kuraray N-720 polyester/co-polyester core/sheath binder fibers. No Kuraray 105-2 PVA binder fibers are used.

Alternatively, an equal weight percent of Teijin polyester staple fibers having an average length of 5 mm and a denier of 0.5 can be substituted for the Kuraray chopped polyester staple fibers in the polyester-based synthetic paper. In accordance with other variations, an equal weight percent of polyethylene pulp can be substituted for the PVA binder fibers.

In accordance with yet another variation, the polyester chopped staple fibers can be combined with either PVA binder fibers or polyester/co-polyester core/sheath binder fibers or with both, but only in an amount sufficient to hold the web together as it is fed to a thermal calendar. The thermal calendar then fuses the polyester chopped staple fibers using rolls heated to temperatures of 360–410° F. (preferably 390° F.) and nip pressures of 40 psi or greater (preferably 50 psi). The resulting base sheet may be optionally coated with pigmented binder as disclosed above.

The fiber composition of the polyester-based synthetic paper is not limited to the specific weight percentages of the examples described above. The amount of PVA binder fibers may be varied from 0 to 10 wt. %; the amount of co-polyester/polyester sheath/core binder fibers may be varied from 0 to 40 wt. %; and the amount of polyester staple fibers may be varied from 50 to 90 wt. %. Furthermore, the average length and the denier of the chopped polyester staple fibers may vary from 5 to 12 mm and from 0.4 to 1.5 denier respectively; and the average length and the denier of the co-polyester/polyester sheath/core binder fibers may vary from 5 to 12 mm and from 2.0 to 6.0 denier respectively.

In accordance with the coated versions of the second preferred embodiment, the starting coating materials are 50 wt. % Vinac 884 ethylene vinyl acetate latex and 50 wt. % Albagloss calcium carbonate. Alternatively, Airflex 4514 ethylene vinyl acetate/ethylene vinyl chloride copolymer latex can be used in place of the Vinac 884 ethylene vinyl acetate latex, although the latter is preferred. The range of calcium carbonate incorporated in the coating can be varied from a pigment/binder ratio of 0.5/1 to 8/1, although the preferred ratio is 1/1. The glass transition temperature $T_g$ of the ethylene vinyl acetate latex may vary from 0° C. to 30° C.

The web material in accordance with the second preferred embodiment can be made on standard papermaking or nonwoven fabric equipment. The polyester cut staple fibers, the polyester/co-polyester core/sheath binder fibers and the polyvinyl alcohol binder fibers are added to water undergoing agitation and containing a predissolved surfactant material, such as Milease T, at a level of 0.5% based on polyester fiber weight. Milease T is commercially available from I.C.I. Americas, Inc.

The foregoing fiber components should be added to the blend chest in the following sequence: (1) polyvinyl alcohol binder fibers, (2) polyester/co-polyester core/sheath binder fibers and (3) chopped polyester staple fibers. The consistency of the mixture in the blend chest should be between 0.5 and 2.5% solids. An anionic polyacrylamide such as 87P061 may be added at levels in the range 0.5–8.0 lbs/ton based on fiber weight to aid in fiber dispersion. 87P061 is commercially available from Nalco Chemical. The mixture is then agitated to attain a uniform dispersion of all materials. The refining step and broke recovery can be bypassed for the second preferred embodiment.

The resulting furnish is then formed on standard wet-lay papermaking equipment at headbox consistencies of 0.7–0.01%. The wet-laid material is then dried in the dryer section.

The dried web is calendared between smooth metal rolls heated to a temperature of 196° C. The web is calendared at minimal pressure, that is, 50–150 PLI, to achieve bonding of the surface fibers while maintaining the degree of opacity of the original sheet.

This material is then ready to be treated with the ethylene vinyl acetate latex solution pigmented with calcium carbonate. As noted above, the treatment may be applied on a paper machine size press or any type of off-line coater or saturator. The coating is applied in a manner that results in a 10 wt. % add-on of dried coating solids, that is, 200 lbs/ton. The coating is then dried. After the coating is dried, the coated web is supercalendared to attain a surface smoothness (Sheffield) of 125–250 units.

The physical properties of the label paper in accordance with the first example of the second preferred embodiment of the invention are listed in Table II.

TABLE II

Physical Property Test Data

| TAPPI No. | Physical Property | Un-coated Base Sheet | Thermally Bonded Sheet | Finished Coated Sheet |
|---|---|---|---|---|
| 410 | Basis Weight (3300 $ft^2$) | 45.0 | 45.0 | 51.3 |
| 411 | Caliper (mils) | 15.6 | 4.8 | 7.9 |
| 251 | Porosity-Permeability Frazier Air (cfm) | 192 | 13 | 38 |
| 451 | Taber V-5 Stiffness (gcm) (MD/CD) | 1.9/1.4 | 1.1/0.9 | 4.2/2.5 |
| 403 | Mullen Burst (psi) | 13 | 126 | 183 |
| 414 | Elmendorf Tear (g) (MD/CD) | 233/261 | 229/168 | 184/138 |
| 511 | MIT Fold (MD/CD) | 3/6 | 2500+/2500+ | 2500+/2500+ |

TABLE II-continued

Physical Property Test Data

| TAPPI No. | Physical Property | Un-coated Base Sheet | Thermally Bonded Sheet | Finished Coated Sheet |
|---|---|---|---|---|
| 494 | Tensile (lbs/in.) (MD/CD) | 4.7/4.6 | 25.0/25.0 | 33.2/43.2 |
| 494 | Elongation (%) (MD/CD) | 1.4/2.2 | 11.2/10.7 | 12.3/15.8 |
| 494 | TEA (ft-lb/$ft^2$) (MD/CD) | 0.7/1.3 | 32.9/32.1 | 40.4/72.9 |
| 452 | GE Brightness (%) | 82.5 | 86.9 | 85.6 |
| 425 | Opacity (%) | 69.0 | 74.2 | 76.5 |

Tests were conducted to determine the effect of PVA binder level on the strength of the synthetic paper made from polyethylene pulp. The results of those tests are shown in Table III. The results show that the tear and tensile strengths of the synthetic paper are better at a 7.5 wt. % PVA binder fiber level than at 4 or 11 wt. %.

TABLE III

Effect of Polyvinyl Alcohol Level

| Physical Property | PVA Level 4% | 7.5% | 11% |
|---|---|---|---|
| Basis Weight (GMS/$m^2$) | 77 | 78 | 72 |
| Caliper (mils) | 7.6 | 7.8 | 7.7 |
| Gurley Porosity (sec/100 cc) | 24 | 19 | 16 |
| Mullen Burst (psi) | 10 | 11 | 6 |
| Elmendorf Tear (g) (MD/CD) | 39/51 | 45/51 | 37/45 |
| MIT Fold (MD/CD) | 16/3 | 23/10 | 11/4 |
| Tensile (lbs/in.) (MD/CD) | 5.3/3.8 | 6.3/4.1 | 5.3/3.1 |
| GE Brightness (%) | 95.2 | 95.0 | 94.3 |
| Opacity (%) | 93.9 | 93.5 | 91.9 |

Tabe IV shows the effect of adding a 10-mm-long polypropylene staple fiber to the furnish. The three samples tested had the following compositions: (A) 90% Mitsui 9400 polyethylene pulp, 10% PVA binder fiber and 0% staple fiber; (B) 90% Mitsui 9400 polyethylene pulp, 0% PVA binder fiber and 10% staple fiber; and (C) 85% Mitsui 9400 polyethylene pulp, 7.5% PVA binder fiber and 7.5% staple fiber. Tear strength is improved as the result of adding staple fiber and the improvement is maximized when a binder fiber is included. Porosity increases as the level of higher-diameter fiber (the binder fiber and the staple fiber) increases. This is one way in which sheet porosity can be controlled when designing synthetic papers for applications where either minimal porosity or a specific level of porosity is required.

TABLE IV

Effect of Staple Fiber Addition

| Physical Property | Sample A | B | C |
|---|---|---|---|
| Basis Weight (GMS/$m^2$) | 67 | 85 | 67 |
| Caliper (mils) | 9 | 11 | 9 |
| Porosity (sec/100 cc) | 18 | 12 | 13 |
| Tear Strength (g) (MD/CD) | 26/30 | 39/39 | 51/55 |

Table V shows the effect of coating or size press applications of a binder. The main effect being designed to is the surface strength so that the web can be printed on without the surface being damaged from the tacky ink on the printing plate. The IGT number shows the improvement when a coating is applied. (IGT is a standard laboratory printing test wherein if the material is weak in the direction perpendicular to the sheet, it will pull apart or large sections of the surface will be pulled out.) A carefully formulated coating can also decrease porosity. Stiffness can be increased or left unchanged by careful selection of the binder.

Thus, in accordance with the invention the porosity of the synthetic paper can be controlled by carefully adjusting the coating formulation and by adjusting the amount of staple fibers.

TABLE V

Effect of Coating

| Physical Property | Uncoated Base Sheet | Finished Coated Sheet |
|---|---|---|
| Basis Weight (GSM) | 60 | 80 |
| Caliper (mils) | 6 | 7 |
| Mullen Burst (psi) | 4 | 9 |
| Tensile (lbs/in.) (MD/CD) | 3.5/2.5 | 6/5 |
| Gurley Porosity (sec/100 cc) | 13 | 22 |
| Brightness (%) | 95 | 95 |
| Opacity (%) | 93 | 93 |
| IGT | 0 | 115 |
| Elongation (%) | 6/8 | 13/15 |
| Gurley Stiffness (mgf) (MD/CD) | 28/20 | 35/35 |

The synthetic paper of the invention can be used in labeling of blow-molded plastic containers. In particular, the label may be applied either in-mold or post-mold to a blow-molded container made of the same synthetic material as the main synthetic fiber component (for example, polyethylene, polyester or polypropylene) of the label with or without the use of an adhesive material and may be recycled along with the container.

In accordance with conventional in-mold labeling of blow-molded plastic containers, labels are sequentially supplied from a magazine and positioned inside the mold by, for example, a vacuum-operated device. Plastic material is then extruded from a die to form a parison as depicted in FIG. 6 of U.S. Pat. No. 4,986,866 to Ohba et al., the description of which is specifically incorporated by reference herein. The mold is locked to seal the parison and then compressed air is fed from a nozzle to the inside of the parison to perform blow molding wherein the parison is expanded to conform to the inner surface of the mold. Simultaneously with the blow molding, the heat-sealable layer of the label of Ohba et al. is pressed by the outer side of the parison and fused thereto. Finally, the mold is cooled to solidify the molded container and opened to obtain a labeled hollow container.

A disadvantage of conventional in-mold labels prepared from paper is that prior to recycling of the plastic container, the paper label must be removed using either solvent or mechanical means to avoid contamination of the recycled plastic material by small pieces of paper.

Although the invention has been described with reference to certain preferred embodiments, it will be appreciated that it would be obvious to one of ordinary skill in the art of fiber technology and papermaking that other polymeric fibers could be used to achieve the same beneficial results. In particular, fibers other than polyethylene pulp and polyester chopped staple fibers can be used as the main fiber component. For example, polyester pulp could be used in place of polyester chopped staple fibers in the event that polyester pulp becomes commercially available. Further, suitable polymeric fibers having a melting point lower than that of the main fiber component can be substituted for PVA binder fibers. For example, polyethylene pulp could be used in place of PVA binder fibers in the polyester-based synthetic paper. Nor is the invention limited to the use of a specific coating binder: suitable coating binders other than ethylene vinyl acetate latex and ethylene vinyl acetate/ethylene vinyl chloride copolymer latex can be used. Also it would be obvious to one of ordinary skill that the preferred embodiments could be readily modified to meet specific conditions not disclosed here. All such variations and modifications are intended to be within the scope and spirit of the invention as defined in the claims appended hereto.

What is claimed is:

1. A high-opacity cellulose-free synthetic paper comprising a nonwoven web of wet-laid 100% thermoplastic fibers comprising polvethylene or polyproylene pulp and polypropylene staple fibers having an average length of 10 mm and a denier of 2.2 being present in an amount between 7.5% to 30%; wherein said fibers are entangled by a wet-lay process on a continuously moving wire and subjected to temperatures below the melting point of said fibers so that the fibers are not fused and result in a continuous web having sufficient tensile strength to be wound as a roll said web having a continuous coating of pigmented binder formed on at least one surface thereof.

2. The synthetic paper as defined in claim 1, wherein said thermoplastic fibers further comprise up to 12% polyvinyl alcohol binder fibers.

3. The synthetic paper as defined in claim 1, wherein said binder comprises ethylene vinyl acetate.

4. The synthetic paper as defined in claim 3, wherein the ratio of pigment to latex lies in the range from 0.5/1 to 8/1.

5. The synthetic paper as defined in claim 1, wherein the fiber composition of said nonwoven web is 1.5 to 10% polyvinyl alcohol binder fibers, and 7.5 to 10% propylene fibers and the remaining amount polyethylene or polyproylene pulp.

6. A method for manufacturing a high-opacity cellulose-free synthetic paper comprising the steps of:

forming a nonwoven web comprising 100% thermoplastic fibers by a wet-lay process, said thermoplastic fibers comprising polyethylene or polyproplene pulp and polypropylene staple fibers having an average length of 10 mm and denier of 2.2 being present in an amount of between 7.5% and 30%;

drying said wet-laid web to remove excess water, said drying being carried out at temperatures below the melting temperature of said thermoplastic fibers;

saturating said dried nonwoven web on at least one side thereof with a pigmented binder forming a continuous coating thereon; and curing said binder at temperatures below said melting temperature of said thermoplastic fibers.

7. The method for manufacturing a synthetic paper as defined in claim 6, wherein said thermoplastic fibers further comprise up to 12% polyvinyl alcohol binder fibers.

8. The method for manufacturing a synthetic paper as defined in claim 6, wherein said binder comprises ethylene vinyl acetate, and the ratio of pigment to latex lies in the range from 0.5/1 to 8/1.

9. The method for manufacturing a synthetic paper as defined in claim 6, wherein the fiber composition of said nonwoven web is 1.5 to 10% polyvinyl alcohol binder fibers, and 7.5 to 10% polypropylene fibers and the remaining amount polyethylene or polypropylene pulp.

10. A nonwoven composite web for use in making high opacity cellulose-free synthetic paper, comprising a nonwoven web of 100% thermoplastic fibers comprising polyethylene or polypropylene pulp; and polypropylene staple fibers having an average length of 10 mm and a denier of 2.2 being present in an amount between 7.5% to 30%; wherein said fibers are entangled by a wet-lay process on a continuously moving wire and subjected to temperatures below the melting point of said fibers so that the fibers are not fused and result in a continuous web having sufficient tensile strength to be wound as a roll.

11. The nonwoven composite web as defined in claim 10, wherein said thermoplastic fibers further comprise up to 12% polyvinyl alcohol binder fibers.

12. The nonwoven composite web as defined in claim 11, wherein the fiber composition of said nonwoven web is 70–91% polyethylene or polypropylene pulp, 1.5–10% polyvinyl alcohol binder fibers and 7.5 to 10% polypropylene fibers.

13. The nonwoven composite web as defined in claim 10, wherein said web is made into a paper and coated with a binder coating.

14. The nonwoven composite web as defined in claim 13, wherein said binder coating is selected from the group consisting of latex, calcium carbonate, titanium dioxide, clay, talc and other inorganic pigments to enhance the printability of the paper.

15. A method for manufacturing a nonwoven composite web for use in making high opacity cellulose-free synthetic paper, comprising the steps of:

dispersing thermoplastic fibers comprising polyethylene or polypropylene pulp, and polypropylene staple fibers having an average length of 10 mm and a denier of 2.2 being present in an amount between 7.5% to 30% to form a mixture having a consistency of up to 5% soilds in water;

agitating said mixture to achieve a uniform dispersion of said fibers and pulp;

forming a nonwoven web from said mixture by a wet-lay process on a continuously moving web; and drying said wet-laid web to remove excess water, said drying being carried out at temperatures below the melting temperature of said pulp so that the fibers are not fused and result in a continuous web of sufficient tensile strength to be wound as a roll.

16. The method for manufacturing a synthetic paper as defined in claim 15, wherein said thermoplastic fibers further comprise up to 12 wt. % polyvinyl alcohol binder fibers.

17. The method for manufacturing a synthetic paper as defined in claim 15, wherein the continuous web is formed into a synthetic paper and coated over at least one surface of the paper with a binder coating.

18. The method for manufacturing a synthetic paper as defined in claim 11, wherein said binder coating is selected from the group consisting of latex, calcium carbonate, titanium dioxide, clay, talc and other inorganic pigments to enhance the printability of the paper.

* * * * *

UNITED STATES PATENT AND TRADEMARK OFFICE

CERTIFICATE OF CORRECTION

PATENT NO. : 6,171,443 B1
DATED : January 9, 2001
INVENTOR(S) : Goettmann et al.

It is certified that error appears in the above-identified patent and that said Letters Patent is hereby corrected as shown below:

Column 3,
Line 63, after "labels" insert -- are --.

Column 4,
Line 24, delete "an ethylene vinyl" and insert -- polyvinyl --.
Line 26, delete "30" and insert -- 33 --.
Line 52, delete "an ethylene vinyl" and insert -- polyvinyl --.
Line 54, delete "30" and insert -- 33 --.

Column 5,
Lines 46 and 50, delete "ethylene vinyl" and insert -- polyvinyl --.
Line 48, delete "ethylene vinyl" acetate/"
Line 49, delete "copolymer".
Line 54, delete "5100 Tilghman Street, Allentown, Pennsylvania 18104" and insert -- 7201 Hamilton Blvd., Allentown, Pennsylvania 18195-1501 --.

Column 7,
Lines 20 and 31, delete "ethylene vinyl" and insert -- polyvinyl --.

Column 8,
Line 5, delete "an ethylene vinyl" and insert -- polyvinyl --.
Line 6, delete "30" and insert -- 33 --.
Lines 64 and 67, delete "ethylene vinvyl" and insert -- polyvinyl --.
Line 66, delete "ethylene vinyl acetate/" and "copolymer".

Column 9,
Lines 5 and 38, delete "ethylene vinvyl" and insert -- polyvinyl --.
Line 5, delete "30" and insert -- 33 --.

Column 12,
Line 6, delete "ethylene vinyl" and insert -- polyvinyl --.
Line 7, delete "ethylene vinyl acetate/".
Line 8, delete "copolymer".

Column 12, claim 1,
Line 16, delete "polvethylene" and insert -- polyethylene --.

UNITED STATES PATENT AND TRADEMARK OFFICE

CERTIFICATE OF CORRECTION

PATENT NO. : 6,171,443 B1
DATED : January 9, 2001
INVENTOR(S) : Goettmann et al.

It is certified that error appears in the above-identified patent and that said Letters Patent is hereby corrected as shown below:

Column 12, claim 3,
Line 29, delete "ethylene vinyl" and insert -- polyvinyl --.

Column 12, claim 5,
Line 36, delete "polyproylene" and insert -- polypropylene --.

Column 12, claim 8,
Line 58, delete "ethylene vinyl" and insert -- polyvinyl --.

Signed and Sealed this

Fifteenth Day of January, 2002

*Attest:*

*Attesting Officer*

JAMES E. ROGAN
*Director of the United States Patent and Trademark Office*